US006314884B1

(12) United States Patent
Reiner

(10) Patent No.: US 6,314,884 B1
(45) Date of Patent: Nov. 13, 2001

(54) REGISTER CONTROL DEVICE FOR A PRINTING MACHINE

(75) Inventor: Franz Reiner, Oberursel (DE)

(73) Assignee: MAN Roland Druckmaschinen AG (DE)

( * ) Notice: Subject to any disclaimer, the term of this patent is extended or adjusted under 35 U.S.C. 154(b) by 0 days.

(21) Appl. No.: 09/383,516

(22) Filed: Aug. 26, 1999

(30) Foreign Application Priority Data

Aug. 28, 1998 (DE) ..... 298 15 443 U

(51) Int. Cl.[7] ..... B41F 1/34; B41F 21/12; B41F 21/14; B41L 1/02; B41L 3/02

(52) U.S. Cl. ..... 101/481; 101/485; 101/486

(58) Field of Search ..... 101/248, DIG. 36, 101/382.1, 383, 389.1, 477, 481, 485, 486, 415.1

(56) References Cited

U.S. PATENT DOCUMENTS 5,394,614 * 3/1995 Lindner et al. ..... 101/415.1
5,461,980 * 10/1995 Maejima et al. ..... 101/415.1

FOREIGN PATENT DOCUMENTS 298 08 098 U1 8/1998 (DE) .
298 08 099 U1 8/1998 (DE) .
0 551 976 A1 7/1993 (EP) .
0 555 782 A1 8/1993 (EP) .

* cited by examiner

*Primary Examiner*—Kimberly Asher
(74) *Attorney, Agent, or Firm*—Leydig, Voit & Mayer, Ltd.

(57) ABSTRACT

A register control device for the cylinder of a printing machine that emits a signal when a printing plate is resting in register on one or more register pins associated with a print cylinder. The signal is communicated to a stationary evaluation unit by a magnetic field. In this regard, a magnetic field sensor is attached to the printing machine frame and is used to detect the signal and forward the signal to the evaluation unit. The evaluation unit uses the communicated signal to determine whether or not insertion of the printing plate was properly performed.

10 Claims, 1 Drawing Sheet

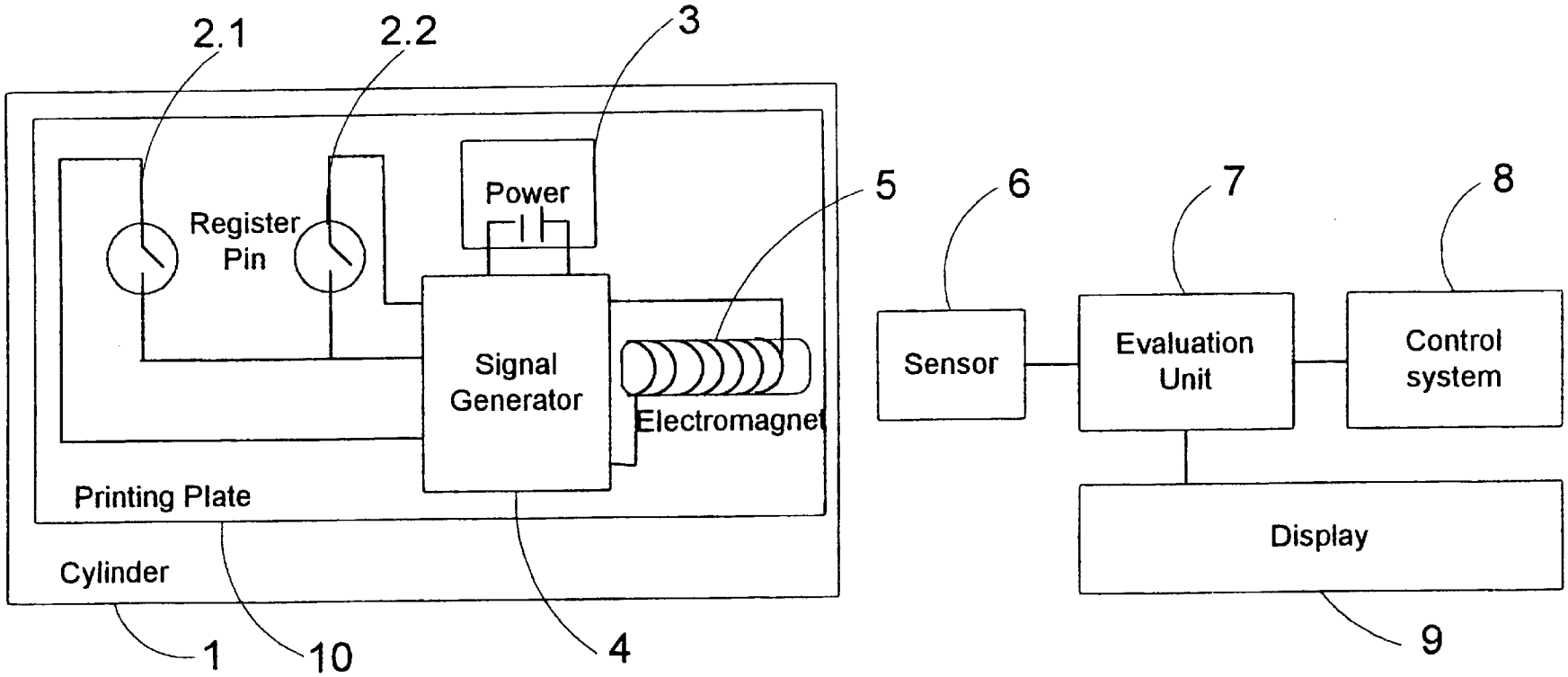
8
Control system
7
Evaluation Unit
9
Display
6
Sensor
5
Electromagnet
3
Power
Signal Generator
4
2.2
Register Pin
2.1
10
Printing Plate
1
Cylinder

REGISTER CONTROL DEVICE FOR A PRINTING MACHINE

TECHNICAL FIELD

This invention relates generally to printing machines and, more particularly, to a register control device for a printing machine.

BACKGROUND OF THE INVENTION

In a sheet-fed offset printing machine, a printing plate is fastened on a plate cylinder by means of a clamping rail allocated to the leading edge of the printing plate and a clamping rail allocated to the trailing edge. An example of such a printing machine may be seen in U.S. Pat. No. 5,511,478 (DE 43 39 344 C1) which discloses a device for the automatic changing of printing plates in a printing machine. Here, a printing plate, which is to be inserted, has certain built in guards to stop movement and a guide device to assist its contact with the cylinder and insertion into the clamping rail of the edges. After this plate has been inserted into the clamping rail and the plate's leading edge has been clamped, the plate is drawn onto the cylinder by the latter being rotated forwards. During insertion into the leading edge clamping rail and the drawing process, the central or rear part of the printing plate still makes contact with the guard.

To assure high print quality, printing plates are usually fitted to the plate cylinder in a precise location using a register system. For example, U.S. Pat. No. 5,383,402 (EP 0 551 976 A1) discloses a register system for mounting a plate on a plate cylinder that includes a plate lockup device, reference pins and a lamp. The plate lockup device is provided in a gap formed in the circumference surface of the plate cylinder. The reference pins are electrically rendered conductive by contacting an insertion end of a plate inserted into the plate lockup device, thereby detecting insertion of the plate. The lamp confirms and indicates insertion of the plate from an output from the reference pins thereby allowing a manual installation of a printing plate to visually verified.

In the case of automatic printing plate changers, the signal from register interrogation is evaluated by a control system, so that, following the feeding of a new printing plate and the establishment of the in-register position, the appropriate clamping rail can be closed in order to mount the plate. The control system which evaluates the signal, effects the closing of the rail and triggers the further processing of the changing operation is arranged outside of the cylinder. Thus, the signal from the electrically interrogable register pins is required to be lead out of the cylinder.

For leading the signal from the cylinder to the control unit, a rotary transmitter, such as a slip ring transmitter is commonly employed. However, the presence of a such a rotary transmitter assumes that there is appropriate installation space at one end of the cylinder. This installation space is not always available, in particular, in the case of plate cylinders having equipment for lateral and circumferential register adjustment. A slip ring transmitter also brings with it the disadvantage that soiling of the contacts may lead to signal interference, which in turn causes disruption to the plate-changing operation.

By way of further example, EP 0 551 976 discloses equipment for electrical register interrogation in which the signals from the electrically interrogable register pins are looped out via contact areas fitted to the plate cylinder. Corresponding contacts can by brought into contact with the contact areas fitted to the cylinder, these contacts being connected to a circuit which evaluates the signals. However, the disadvantage in this case is that appropriate space for the contact areas has to be provided on the cylinder and on the frame. Again, the soiling of the contact area enhances the risk of an erroneous signal transmission.

Still further, U.S. Pat. No. 5,320,041 (EP 0555782) discloses equipment for electrical register, in which signals from electrically interrogable register pins are looped out of the cylinder via a spit transformer. For this purpose, the cylinder has an appropriate transmission coil, towards which a further coil may be brought at a specific angular position of the cylinder. Because of the inductive signal transmission, the two coils need to be brought as close to one another as possible and thus it is necessary to provide an item of equipment which can be brought towards and away from the cylinder. Accordingly, this device suffers the aforementioned disadvantages.

Finally, DE 298 08 098 and DE 298 08 099 disclose equipment for register control in which the signals generated in the cylinder are led out by means of radiowaves and, respectively, optical beam transmission. The signal generated in each case may be encoded. Nevertheless, the transmission of radio or optical signals is not possible under specific machine conditions, for example, if other radiation sources or interference sources are present in the area of the cylinder.

SUMMARY OF THE INVENTION

To overcome these disadvantages, the present invention is generally realized in an expanded register control system for a cylinder of a printing machine. The system is adapted to form a magnetic field that can be detected be a special device fixed to the frame of the printing machine. A power source located within the cylinder may give the register pins, which are electrically insulated and located on the cylinder, a predefined potential. When the printing plate is properly inserted onto the cylinder an electric circuit will be formed. The formation of the circuit should cause an electromagnetic source, which is attached to the cylinder, to become energized.

When the electromagnetic source is energized, it should create a magnetic field. A sensor located near the cylinder and attached to an evaluation unit should be able to detect any magnetic field. The sensor should be able to determine the strength and source of the field. The evaluation unit combined with the sensor should then be able to detect whether the printing plate was properly inserted and trigger any further action on the part of the printing machine.

BRIEF DESCRIPTION OF THE DRAWINGS

While the appended claims set forth the features of the present invention with particularity, the invention, together with its objects and advantages, may be best understood from the following detailed description taken in conjunction with the accompanying drawing illustrating an exemplary printing machine constructed in accordance with the present invention.

DETAILED DESCRIPTION OF THE INVENTION

Turning now to the FIGURE, there is illustrated an example of a printing machine in which the present invention resides. In this regard, the FIGURE shows the cylinder 1 with the signal transmission equipment fitted within, as well as the magnetic field sensor fixed to the frame. Two electrically conductive register pins 2.1 and 2.2 are arranged within the cylinder 1. They are to be fitted so that they are electrically insulated to the cylinder 1 and to the clamping rail. This allows the in-register position of a metallic printing plate to be detected by the register pins 2.1 and 2.2. The register pins 2.1 and 2.2 have built in switches where one end is connected to a signal generator 4 which is also within the cylinder 1. Also within the cylinder is a power supply 3, which is connected to the signal generator 4. The power supply is the source of the voltage that may eventually be applied to the register pins 2.1 and 2.2 via the signal generator.

The signal generator 4 is also connected to the magnetic field producing equipment 5. In the FIGURE, this equipment is composed of a coil associated with an electromagnet. When the register pins 2.1 and 2.2 are in-register position, the circuit is closed and a current should flow through the coil generating a magnetic field. A sensor 6, that should detect any magnetic fields, is fixed to the frame and is opposing the magnetic field producing equipment 5.

The sensor 6 is connected to an evaluation unit 7 that has an indicator 9 for displaying whether or not the printing plate is in-register. The evaluation unit 7 is also connected to a control system 8, which may trigger the printing plate changing operation.

In the preferred embodiment, this invention is designed to produce a magnetic field that can allow equipment to determine whether a printing plate has been inserted properly and whether or not to initiate the automatic insertion process. The register pins are electrically insulated with respect to the clamping rail and the entire cylinder. A signal generator located within the cylinder should bring the register pins to a specific potential. The signal generator can be connected to any sort of power supply such as a battery or accumulator that can provide it the necessary power to generate a specified voltage. When a printing plate is properly inserted, i.e. in-register, the switches in the register pins should be closed, thus creating a circuit with current. The current should flow through a coil attached to the signal generator. This coil is associated to an electromagnet. When the current is flowing through the coil, the electromagnet should generate a magnetic field.

To detect the magnetic field, a sensor is fixed to the frame of the printing machine at a location opposite of the electromagnet. The preferred type of sensor would include a Hall probe, but it could be any type of sensor such as a magnetic field-dependent resistor or others known to those skilled in the art. When current passes through a magnetic field sensor or as in this case the sensor is energized by a magnetic field, a Hall voltage is produced. An evaluation unit connected to the sensor can then detect this voltage. The evaluation unit can evaluate the voltage or lack of one and determine whether or not the printing plate was properly inserted. This may be displayed via an indicator connected to the evaluation unit. The evaluation unit may also be connected to a control system. The control system can get the feed from the evaluation unit. The control unit can control the automatic printing plate change operation and use the information from the evaluation unit to make decisions.

More specifically, there can be more then one sensor, one coil, and one electromagnet. For example, a Hall probe can be fixed to the frame for each register pin. Thus, it can be determined when each register pin individually is resting in-register with the printing plate. To facilitate this the Hall probes can also be attached to a guide device or pressure roller that can be brought into contact with the cylinder while the printing plate is being inserted.

Another embodiment of the invention is to use only one sensor and a single coil. In this case, the coil will only produce a magnetic field when both or all of the register pins make contact with the printing plate in the correct position.

In another embodiment of the invention, the signal generator may send different pulses of a predefined length and frequency to each register pin. When the switch in a register pin is closed, the circuit is complete, and a pulse should flow through the coil, which will activate the electromagnet. The electromagnet can then send voltage waveforms, corresponding to the pulse sent to each register pin from the signal generator, to a stationary Hall probe assigned to the electromagnet. This allows the status of each register pin to be sent in coded form using only one coil and one sensor. The evaluation unit can then determine which, if any, of the register pins are not in-register.

All of the references cited herein, including patents, patent applications, and publications, are hereby incorporated in their entireties by reference.

In view of the many possible embodiments to which the principles of this invention may be applied, it should be recognized that the embodiment described herein with respect to the drawing figures is meant to be illustrative only and should not be taken as limiting the scope of invention. Therefore, the invention as described herein contemplates all such embodiments as may come within the scope of the following claims and equivalents thereof.

We claim:

1. A register control device for use with a printing machine, the register control device comprising:

a pair of register pins adapted to be engaged by a printing plate of the printing machine;

a signal generator driving an electromagnet for producing a magnetic field as a function of the register pins engaging the printing plate;

a sensor for detecting the magnetic field generated by the electromagnet; and an evaluation unit in communication with the sensor for monitoring the position of the printing plate with respect to the register pins as a function of the magnetic field.

2. The device of claim 1, wherein the sensor comprises a Hall probe.

3. The device of claim 1, wherein the sensor comprises a magnetic field-dependent resistor.

4. The device of claim 1, wherein the signal generator is adapted to generate a sequence of signals and the sensor is adapted to detect this sequence of signals.

5. The device of claim 1, further comprising a power supply disposed within a cylinder connected to the signal generator.

6. The device of claim 5, wherein the power supply comprises a battery.

7. The device of claim 5, wherein the power supply comprises an accumulator.

8. A method for determining and encoding registration status of a printing plate and a printing cylinder of a printing machine, the method comprising:

setting a state for each of a plurality of register pins of the printing cylinder in response to a position of the printing plate;

sending a distinct input signal to each register pin;

detecting a plurality of output signals from the register pins generated from the distinct input signals;

encoding the plurality of output signals from the register pins into magnetic field signals corresponding to the states of the register pins;

transmitting the magnetic field signals to a sensor; and evaluating an output signal of the sensor to determine the registration status of the printing plate and the printing cylinder at each register pin.

9. An apparatus for determining the registration status of a printing plate and a printing cylinder of a printing machine, the apparatus comprising:

a plurality of register pins located in the printing cylinder for registering the printing plate to the printing cylinder;

a signal generator connected to the register pins for generating and sending distinct input signals to the register pins;

an encoder for receiving output signals from the register pins and encoding them into magnetic field signals according to a state of the register pin;

a transmitter for transmitting the magnetic field signal to a sensor; and an evaluation unit connected to the sensor for evaluating an output signal from the sensor to determine the registration status of the printing plate and the printing cylinder at each register pin.

10. The apparatus of claim 9, wherein the encoder and the transmitter device are electromagnets.

* * * * *